United States Patent [19]

Labrijn

[11] Patent Number: 4,903,404

[45] Date of Patent: Feb. 27, 1990

[54] SHAVING APPARATUS

[75] Inventor: Hans Labrijn, Drachten, Netherlands

[73] Assignee: U.S. Philips Corp., New York, N.Y.

[21] Appl. No.: 263,653

[22] Filed: Oct. 27, 1988

[30] Foreign Application Priority Data

Nov. 24, 1987 [NL] Netherlands ..... 8702811

[51] Int. Cl.[4] ..... B26B 19/26

[52] U.S. Cl. ..... 30/34.1; 30/43.6

[58] Field of Search ..... 30/34.1, 34 R, 32, 43.1, 30/43.6, 34.05

[56] References Cited

U.S. PATENT DOCUMENTS

| | | | |
|---|---|---|---|
| 2,917,824 | 12/1959 | Brauss | 30/34.1 |
| 3,781,990 | 1/1974 | Loner | 30/34.1 |
| 3,997,967 | 12/1976 | De Boer | 30/34.1 |
| 4,085,503 | 4/1978 | Beck et al. | 30/34.1 |

FOREIGN PATENT DOCUMENTS 50-44307 12/1975 Japan .

*Primary Examiner*—Douglas D. Watts
*Attorney, Agent, or Firm*—Ernestine C. Bartlett

[57] ABSTRACT

The invention relates to a shaving apparatus comprising a housing, at least one shaving unit and a trimmer, which is movable relative to the housing between an operational position and an operating position by means of a push-button, a spring being arranged between the trimmer frame and the housing. The housing is provided with a pivotable catch having a hook-shaped end which engages behind the latching projection on the trimmer frame in the rest position, and which is situated before the latching projection in the operational position, and around the latching projection the trimmer frame is provided with guide walls which define a forward path and a return path for the hook-shaped end.

3 Claims, 2 Drawing Sheets

SHAVING APPARATUS

BACKGROUND OF THE INVENTION

The invention relates to a shaving apparatus comprising a housing, at least one shaving unit, and a trimmer, which is movable relative to the housing between an operational position and a rest position by means of a push-button, a spring being arranged between a trimmer frame and the housing.

Such a shaving apparatus is known, for example, from Japanese Utility-Model Application 50-44307. This known construction employs a separate push-button which can be latched in two positions by means of a triangular resilient element and a slide member.

SUMMARY OF THE INVENTION

An object of the invention is to provide a simple yet reliable construction comprising a small number of parts and enabling the button to be secured directly to the trimmer frame.

The construction in accordance with the invention is characterized in that the housing is provided with a pivotable catch having a hook-shaped end which engages behind a latching projection on the trimmer frame in the rest position and which is situated before the latching projection in the operational position, and in that around the latching projection the trimmer frame is formed with guide walls defining a forward and return path for the hook-shaped end.

In special embodiments, the hook-shaped end engages against a bottom wall of the trimmer frame under the influence of a spring; walls are provided which extend transversely of the bottom wall, and the bottom wall has differences in level at the location of the paths for the hook-shaped end; and/or the catch comprises an arm, the spring between the trimmer frame and the housing bearing against said arm.

An embodiment of the invention will now be described in more detail, by way of example, with reference to the Figures.

DETAILED DESCRIPTION OF PREFERRED EMBODIMENTS

The dry-shaving apparatus as shown in FIGS. 1 to 4 comprises a housing 1, two shaving units 2 and one trimmer 3. The shaving units 2 are, for example, of the well-known rotary-cutter type.

Figure 1:
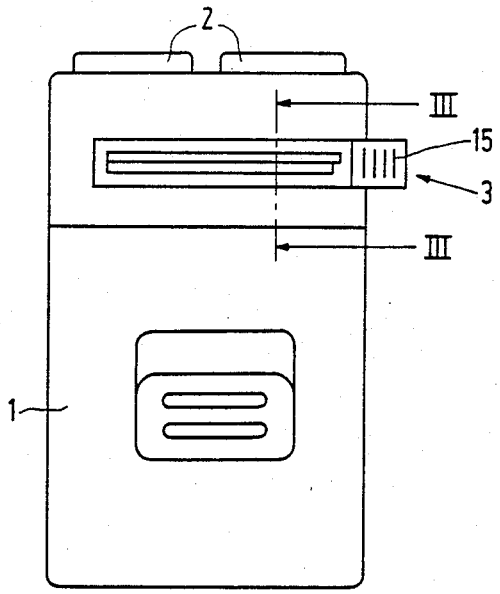
FIG. 1 is a front view of a shaving apparatus in accordance with the invention.
Figure 2:
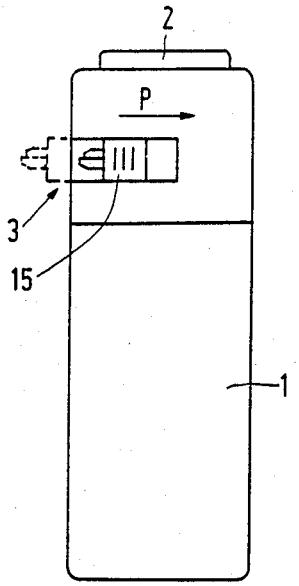
FIG. 2 is a side view of the shaving apparatus shown in FIG. 1.
Figure 3:
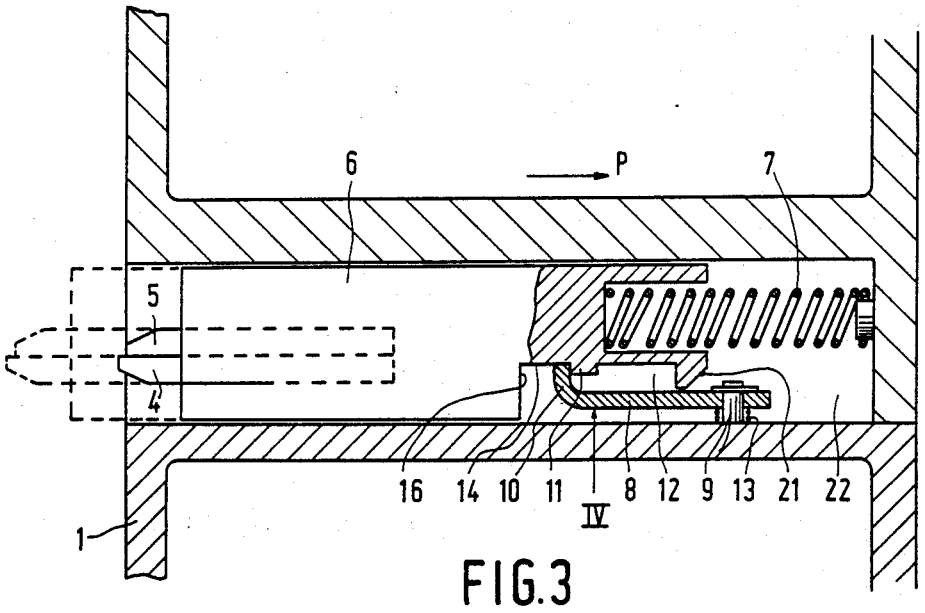
FIG. 3 is an enlarged-scale sectional view taken on the line III—III in FIG. 1.

The trimmer 3 is movable between a rest position and an operational position, the latter position being indicated in broken lines in FIGS. 2 and 3. The trimmer 3 comprises a stationary cutter 4 and a drivable cutter 5, which cutters are mounted on a trimmer frame 6. A compression spring 7 is arranged between the trimmer frame 6 of the housing 1. Both the trimmer 3 and the shaving unit 2 can be driven, in known manner, by the same electric motor, which is not shown for the simplicity of the Figures.

The housing 1 is provided with a catch 8 which is pivotable on a spindle 9 into and out of engagement with a latching projection 11. In the rest position the hook-shaped end 10 of the catch 8 engages behind a latching projection 11, which forms part of the trimmer frame 6 and is situated in a recess 12 in the trimmer frame. The spring 13 around the spindle 9 constantly urges the hook-shaped end 10 against the bottom wall 14 of the recess 12. Since the hook-shaped end 10 engages behind the latching projection the compression spring 7 cannot urge the trimmer 3 outwards into the operational position.

Figure 4:
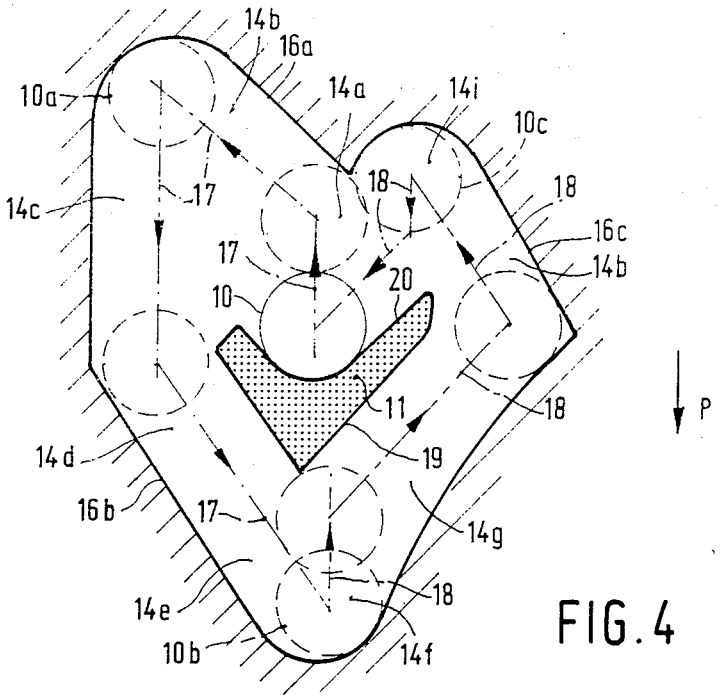
FIG. 4 shows a part of the apparatus in an enlarged scale view taken on the line IV in FIG. 3.

The trimmer frame 6 is provided with a push-button 15, which projects from the housing 1. By pressing the push-button 15 in the direction P the trimmer 3 can be moved in the direction P, opposed by the action of the compression spring 6. As a result of this, the hook-shaped end will contact the guide wall 16, which forms part of the trimmer frame, which bounds the recess 12 and which extends transversely of the bottom wall 14. This guide wall 16 is situated around the latching projection 11 and defines a forward path 17 and a return path 18 for the hook-shaped end 10, as is indicated in FIG. 4. In this Figure the hook-shaped end 10 is represented as a circle and the remainder of the catch 8 is not shown for the sake of simplicity. The rest position, in which the hook-shaped end engages against the latching projection 11, is indicated by a dashed circle 10. Other positions of the hook-shaped end as it traverses the paths 17 and 18 are indicated by dashed circles. Starting from the rest position the hook-shaped end 10 will first engage with the guide wall portion **16*a* as a result of the movement of the trimmer frame 6 in the direction P. This wall portion 16*a* will urge the hook-shaped end 10 sidewards relative to the direction P, so that it follows the path 17 until the position indicated by 10*a* is reached. This movement of the hook-shaped end 10 is obviously possible because the catch 8 is pivotable about the spindle 9. If the button 15 is now released, the spring 7 causes the trimmer frame 6 to move in a direction opposite to that indicated by P, the guide-wall portion 16*b* ensuring that the hook-shaped end follows the path 17 until position 10*b* of the hook-shaped end 10 is reached. The trimmer 3 is now in the operational position, a further outward movement of the trimmer being impossible because the hook-shaped end 10 engages behind the guide wall 16 in position 10*b*. Forces acting on the trimmer 3 in the direction of the arrow P during use of the trimmer are counteracted by the compression spring 7**.

By again pressing the push-button 15 in the direction indicated by the arrow P the trimmer 3 can be returned to the rest position. The hook-shaped end will then consecutively engage with the wall portion 19 of the latching projection 11, the guide-wall portion **16*c*, and the wall portion 20 of the latching projection 11, so that the hook-shaped end 10 is again forced to follow the return path 18 until the end 10 again engages behind the latching projection 11. If the hook-shaped end, as it follows the path 18, has reached position 10*c***, the push-button may be released.

With the construction described in the foregoing the trimmer can simply be set to the operational position or the rest position by means of the push-button 15. The trimmer frame 6 together with the push-button 15, the latching projection 11 and the guide walls 16 can be manufactured simply and cheaply as an integral unit from a plastics. The only other separate parts for the trimmer-latching mechanism then comprise the catch 8 and the springs 7 and 13. Mounting can be simplified by providing the trimmer frame with an inclined run-on surface 21, so that the hook-shaped end 10 automatically snaps into the recess 12 when the trimmer frame 6 is slid into the compartment 22 of the housing 1.

Figure 5:
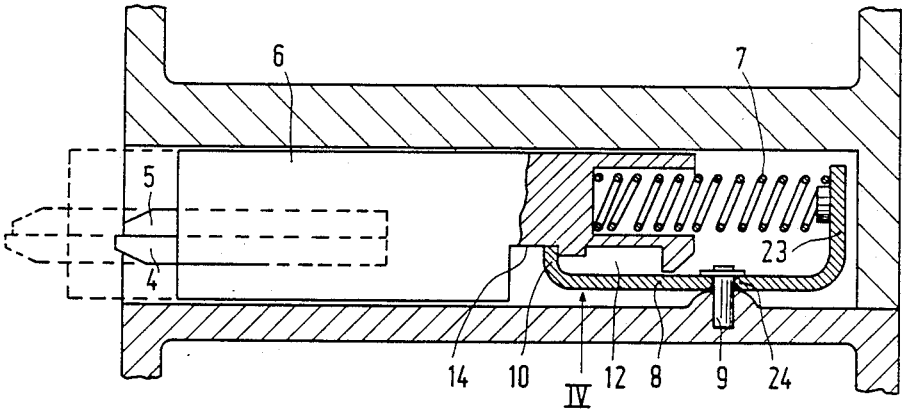
FIG. 5 is a modification of the embodiment shown in FIGS. 1 to 4.

In the embodiment shown in FIG. 5 the catch 8 comprises an arm 23 against which the spring 7 bears. The shape of the portion 24 bearing on the spindle 9 is lightly spherical. Under the influence of the spring 7 the hook-shaped end 10 is now urged against the bottom wall 14 of the recess 12, enabling the spring 13 used in the embodiment shown in FIG. 3 to be dispensed with.

Figure 6:
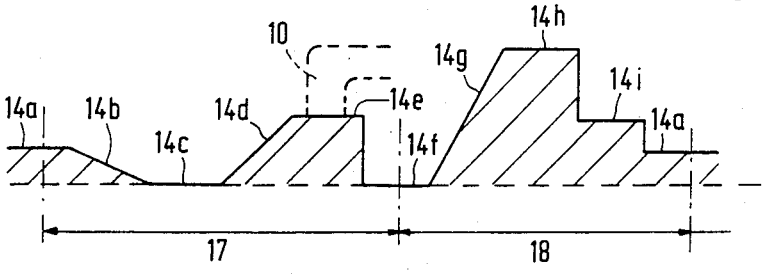
FIG. 6 is a development of the bottom profile of the part shown in FIG. 4.

To ensure that the hook-shaped end 10 keeps following the paths 17 and 18, in particular at those locations where the hook-shaped end 10 is to be moved sidewards relative to the direction indicated by the arrow P, differences in level, for example, variations in height from the horizontal plane may be provided with the bottom wall 14 at the location of the paths 17 and 18. FIG. 6 is a development showing how the level or height of the bottom wall varies along the paths 17 and 18 for the bottom-wall portions **14*a* to 14*i*, the hook-shaped end 10 being shown in broken lines at an arbitrary location. The differences in level are shown to an enlarged scale and in practice they will be only some tenths of millimetres. FIG. 4 also shows the bottom portions 14*a* to 14*i***, but they are not essential for the construction shown in this Figure.

Instead of at the left-hand side of the trimmer frame 6, as is shown in FIG. 3, the trimmer cutters 4 and 5 may be arranged at the right-hand side of the trimmer frame, the remainder of the construction being the same, but the trimmer being slidable in an outward direction through an opening in the right-hand side of the housing 1. The trimmer is then in the operational position if the trimmer frame 3 and the catch 8 are in the position shown in FIG. 3. This has the advantage that forces which may occur during trimming and which tend to move the trimmer 3 inwards are taken up by the catch 8 and not by the spring 7.

What is claimed is:

1. A shaving apparatus comprising a housing, at least one shaving unit, and a trimmer, which is movable relative to the housing between an operational position and a rest position by means of a push-button, a spring being arranged between a trimmer frame and the housing, wherein the housing is provided with a pivotable catch having a hook-shaped end which is pivotable into and out of engagement with a latching projection of the trimmer frame, movement of said hook-shaped end being stopped by engagement with said latching projection in the rest position, said hook-shaped end being free of engagement by said latching projection in the operational position, and wherein around the latching projection the trimmer frame is formed with guide walls defining a forward and return path for the hook-shaped end.

2. A shaving apparatus as claimed in claim 1, wherein the hook-shaped end engages against a bottom wall of the trimmer frame under the influence of a spring; guide walls are provided which extend transversely of the bottom wall; and the bottom wall has variations in height from the horizontal plane at the location of the paths for the hook-shaped end.

3. A shaving apparatus as claimed in claim 2, wherein the catch comprises an arm, the spring between the trimmer frame and the housing bearing against said arm.

* * * * *